US006059106A

United States Patent [19]

Baker et al.

[11] Patent Number: 6,059,106

[45] Date of Patent: May 9, 2000

[54] TOOTHBRUSH DISPLAY AND STORAGE PACKAGE

[75] Inventors: Bradley William Baker, Pleasanton, Calif.; Joseph Michael Kornick; Jose Tirso Olivares, both of Chicago, Ill.

[73] Assignee: Gillette Canada Inc., Quebec, Canada

[21] Appl. No.: 09/176,129

[22] Filed: Oct. 21, 1998

[51] Int. Cl.[7] ..... B65D 83/10

[52] U.S. Cl. ..... 206/361; 206/368; 206/464; 206/467; 206/471; 206/806

[58] Field of Search ..... 206/361, 362.2, 206/15.2, 363, 368, 464, 467, 470, 471, 806, 362.1

[56] References Cited

U.S. PATENT DOCUMENTS

| | | | |
|---|---|---|---|
| 1,179,800 | 4/1916 | Carswell . | |
| 1,274,133 | 7/1918 | Ausubel . | |
| 1,458,566 | 6/1923 | Welpley . | |
| 1,479,800 | 1/1924 | Feldstein . | |
| 1,566,889 | 12/1925 | Lundgren . | |
| 1,790,085 | 1/1931 | Barringer et al. . | |
| 2,353,517 | 7/1944 | Spanel et al. . | |
| 2,419,745 | 4/1947 | Trecek . | |
| 2,538,337 | 1/1951 | Spears . | |
| 2,798,784 | 7/1957 | Marshall . | |
| 2,815,057 | 12/1957 | Tupper . | |
| 2,845,104 | 7/1958 | Frankel . | |
| 3,064,402 | 11/1962 | Crane, Jr. . | |
| 3,111,220 | 11/1963 | Bostrom | 206/471 |
| 3,127,985 | 4/1964 | Scott . | |
| 3,131,069 | 4/1964 | Goller et al. . | |
| 3,192,681 | 7/1965 | Greenbaum . | |
| 3,203,542 | 8/1965 | Lightner et al. . | |
| 3,211,503 | 10/1965 | Barnes . | |
| 3,220,543 | 11/1965 | McCord et al. . | |
| 3,298,515 | 1/1967 | Watts, Jr. . | |
| 3,301,395 | 1/1967 | Swezey . | |
| 3,349,901 | 10/1967 | Brautigam . | |
| 3,352,409 | 11/1967 | Link . | |
| 3,353,664 | 11/1967 | Armentrout et al. . | |
| 3,369,660 | 2/1968 | Hartman . | |
| 3,407,928 | 10/1968 | Watts, Jr. . | |
| 3,450,452 | 6/1969 | Reid . | |
| 3,511,433 | 5/1970 | Andrews et al. . | |
| 3,641,697 | 2/1972 | Heidtman et al. . | |
| 3,776,375 | 12/1973 | Rohdin . | |
| 3,857,487 | 12/1974 | Misslin . | |
| 3,861,528 | 1/1975 | Damuth . | |
| 3,883,197 | 5/1975 | Reid . | |
| 3,891,088 | 6/1975 | Huebner . | |
| 4,019,632 | 4/1977 | Greenlee . | |
| 4,046,251 | 9/1977 | Bruml . | |
| 4,119,203 | 10/1978 | Kuchenbecker . | |
| 4,213,531 | 7/1980 | Rae . | |
| 4,236,636 | 12/1980 | Kuchenbecker . | |
| 4,244,470 | 1/1981 | Burnham . | |
| 4,349,102 | 9/1982 | Strongwater . | |
| 4,359,158 | 11/1982 | Gringer . | |
| 4,375,262 | 3/1983 | Hrenyo . | |
| 4,480,276 | 10/1984 | George . | |
| 4,496,047 | 1/1985 | Gatley . | |
| 4,512,474 | 4/1985 | Harding . | |
| 4,619,364 | 10/1986 | Czopor, Jr. | 206/379 |
| 4,669,610 | 6/1987 | Lindsey et al. | 206/320 |
| 4,681,223 | 7/1987 | Roberts | 206/354 |
| 4,687,129 | 8/1987 | Cugley . | |

(List continued on next page.)

| | | |
|---|---|---|
| 5,494,252 | 2/1996 | Amit et al. . |

*Primary Examiner*—Paul T. Sewell
*Assistant Examiner*—Nhan T. Lam
*Attorney, Agent, or Firm*—Chester Lekala; Donal B. Tobin; Aubrey C. Brine

[57] ABSTRACT

A plastic blister package for display and storage of a toothbrush has a base member and a closure member connected to one another by an integrally molded hinge. The base member and closure member have a pair of flanges, one overlying the other with package in the closed position, and a lip is provided on flange edge of the base member for receiving the edge of the closure member to seal the cavity formed by the two members. A pair of protuberances extend from the base flange and are received in interfitting engagement with a pair of openings found in the closure flange to substantially lock the package in the closed position.

4 Claims, 4 Drawing Sheets

U.S. PATENT DOCUMENTS

| | | | |
|---|---|---|---|
| 4,795,048 | 1/1989 | Trussardi . | |
| 4,863,054 | 9/1989 | Capetta . | |
| 4,872,551 | 10/1989 | Theros . | |
| 4,884,688 | 12/1989 | Hurst . | |
| 4,899,877 | 2/1990 | Kiernan . | |
| 4,905,830 | 3/1990 | Lin . | |
| 5,018,622 | 5/1991 | Hartley | 206/333 |
| 5,048,684 | 9/1991 | Scott . | |
| 5,060,814 | 10/1991 | Oglesbee . | |
| 5,063,940 | 11/1991 | Adell et al. . | |
| 5,129,527 | 7/1992 | Lataix . | |
| 5,279,417 | 1/1994 | Seaton . | |
| 5,293,993 | 3/1994 | Yates, Jr. et al. | 206/365 |
| 5,435,447 | 7/1995 | Weatherford et al. . | |
| 5,485,919 | 1/1996 | Samberg et al. | 206/461 |

TOOTHBRUSH DISPLAY AND STORAGE PACKAGE

BACKGROUND OF THE INVENTION

The present invention relates to a blister-type package and more particularly to a blister package for use in the display and subsequent storage of a toothbrush.

Blister display packages of various types and configurations are well known in the art and are employed widely in the merchandising field for the display of a given product. Generally, these display packages are a preformed product forming a closure of a substantially transparent plastic material which allows the product to be viewed by the prospective consumer, and may take a number of forms or shapes depending upon the product to be sold. In the case of a toothbrush, the blister package is generally sealed to maintain the product in a sanitary condition, and removal of the toothbrush from the package requires destruction of the package.

It is also known to provide storage containers for a toothbrush in which the toothbrush may be stored during its useful life. These containers are generally manufactured of a rigid plastic material or metal, and are convenient for general storage as well as useful when it is desirable to transport the toothbrush during travel.

In view of the increasing requirement to transport a toothbrush on the person, either for use in required frequent brushing or in travel, a need has arisen for a combined package which is employed for display purposes, substantially employed for storage of the toothbrush during its lifetime, and thereafter discarded with the toothbrush.

It is, therefore, an object of the present invention to provide a plastic blister package which may be employed for display of a toothbrush and for storage of the toothbrush after purchase.

Another object of the invention is to provide a one-piece plastic blister package for display and storage of a toothbrush, which package may be opened and closed a number of times during the useful life of the toothbrush.

Yet another object of the invention is to provide a plastic blister package for display and storage of a toothbrush which provides effective sealing of the brush within the package during display and usage.

Still another object of the invention is to provide a plastic blister package of the type described which is easy to carry and store, and may be discarded after useful life of the toothbrush.

A further object of the invention is to provide a plastic blister package for display and storage of the toothbrush which is simple to manufacture and of minimum dimension to contain the entire toothbrush during display and storage.

SUMMARY OF THE INVENTION

The above objects and other objectives which will become apparent as the description proceeds are accomplished by providing a blister package for the display and storage of a toothbrush which comprises a unitary elongate molded plastic body having a base member, a closure member, and a molded hinge portion connecting a first elongated edge of the base member to a first elongated edge of the closure member to provide for movement of the base member and the closure member from a closed position forming a cavity between the two members for accommodating a toothbrush to an open position allowing access to within the cavity. The base member generally has a second elongated edge opposite the hinge portion and a base member flange disposed adjacent the second elongated edge. The closure member also has a second elongated edge opposite the hinge portion and a closure member flange disposed adjacent the second elongated edge. Both of the second elongated edges are in alignment, and the closure member flange overlies and contacts the base member flange when the base member and the closure member are in the closed position. A protuberance having an outer surface is formed on one of the flanges and an opening is formed in the other of the flanges such that the protuberance outer surface extends through the opening in interference fit to retain the closure member in the closed position.

The base member second edge generally has an upwardly projecting lip formed thereon and the closure member second edge is received in contacting engagement against the lip with the closure member in the closed position.

The base member may have a planar web extending substantially over the width of the base member between the base member first edge and the base member second edge, the base planar web forming the base member flange as a portion thereof. The closure member may also have a planar web extending substantially over the width of the closure member between the closure member first edge and the closure member second edge, the closure member web in like manner forming the closure member flange as a portion thereof.

The blister package generally has a first oval recess extending outwardly from the base member forming a portion of the cavity and the closure member has a second oval recess extending therefrom forming a portion of the cavity, the first oval recess and the second oval recess being disposed in facing relationship with the base member and the closure member in the closed position.

A tab is generally formed on one of the flanges overlying the other of the flanges to facilitate movement of the closure member and the base member from a closed position to an open position, and the blister package is generally manufactured of a molded plastic polyvinyl chloride material.

BRIEF DESCRIPTION OF THE DRAWING

Reference is made to the accompanying drawing in which there is shown an illustrative embodiment of the invention from which its novel features and advantages will be apparent, wherein.

DESCRIPTION OF THE PREFERRED EMBODIMENT

Figure 1:
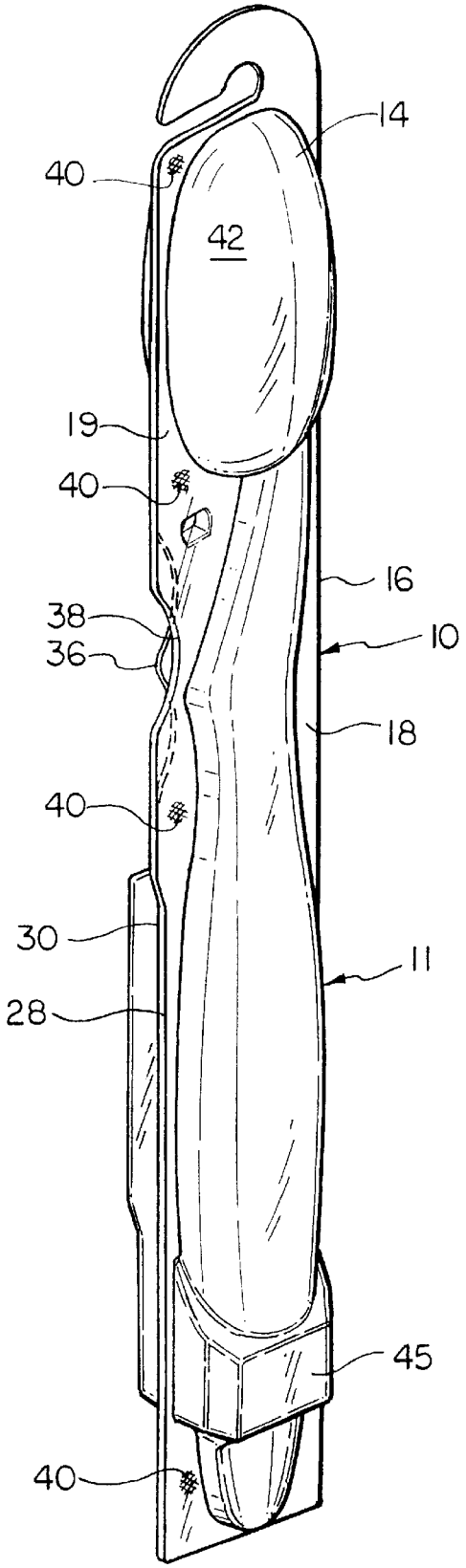
FIG. 1 is a front perspective view showing a blister package for display and storage of a toothbrush, constructed in accordance with the teachings of the present invention.

Referring now to the drawing, there is shown a blister-type package 10 for use in the display and subsequent storage of a toothbrush. The package 10 comprises a body 11 of plastic material, which in the present structure is a polyvinyl chloride. The body 11 is a unitary structure formed of a base member 12 and a closure member 14 interconnected by a hinge portion 16, the hinge portion being of the type generally referred to as a "living hinge," which is formed to be subjected to a plurality of openings and closings of the package 10, without breakage.

Figure 2:
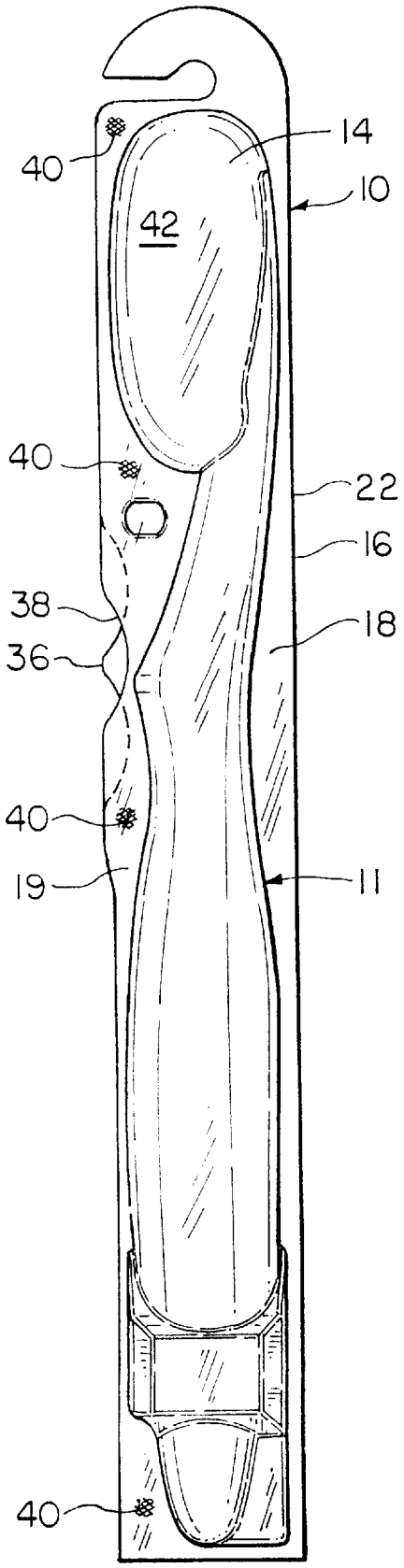
FIG. 2 is a front elevational view of the package of FIG. 1 showing details of the structure.
Figure 3:
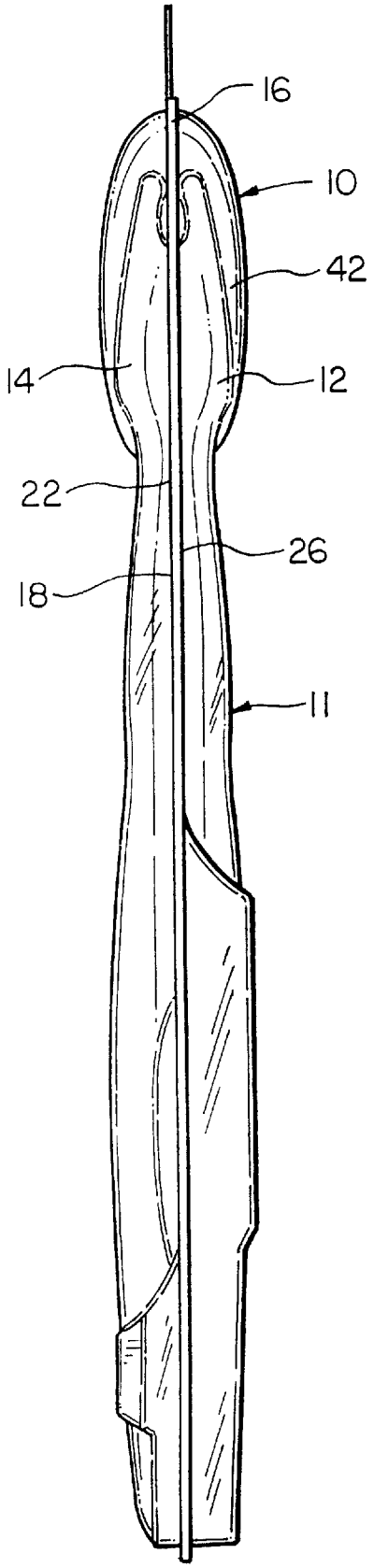
FIG. 3 is a left side elevational view showing further details of the structure of FIGS. 1 and 2.
Figure 4:
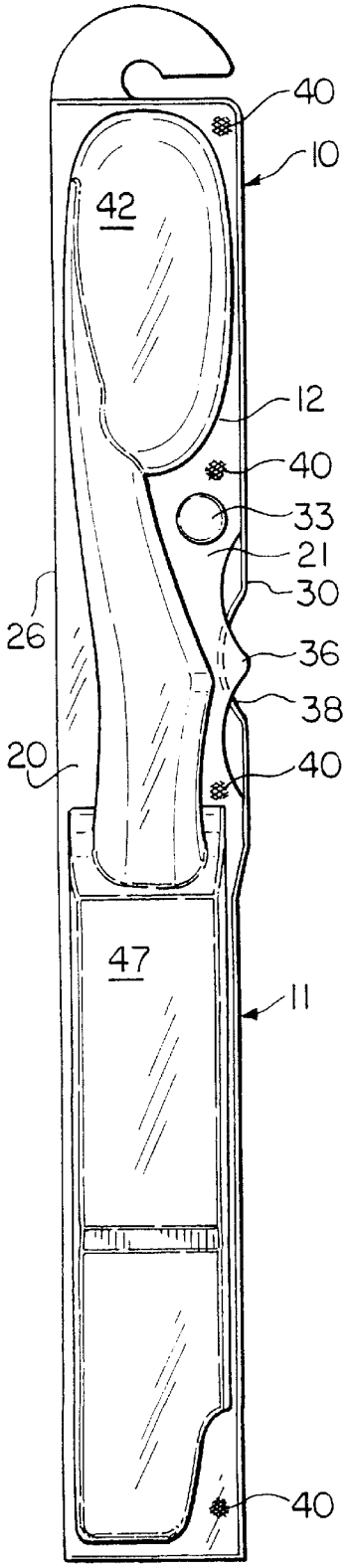
FIG. 4 is a rear elevational view of the package of FIGS. 1 through 3.
Figure 5:
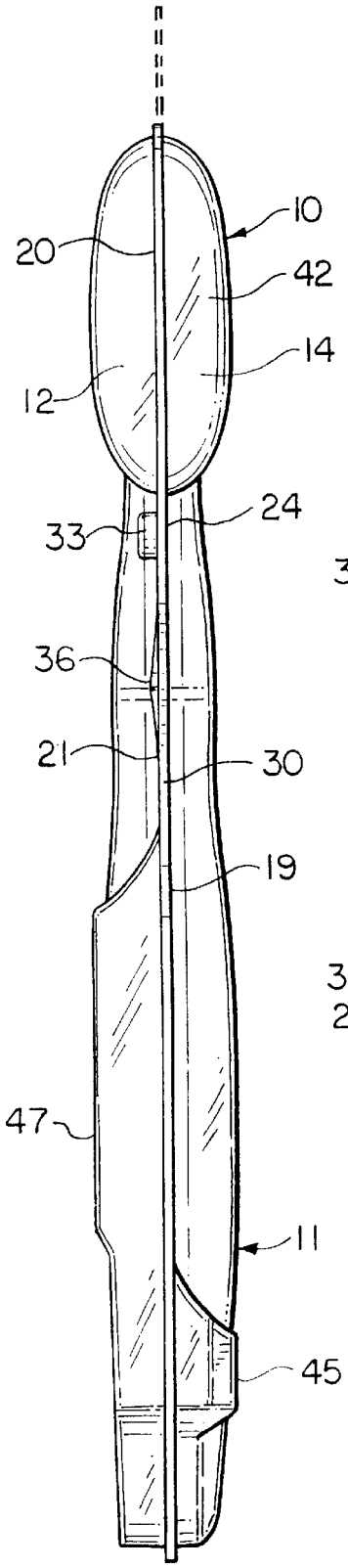
FIG. 5 is a right side elevational view showing details of that portion of the structure.
Figure 6:
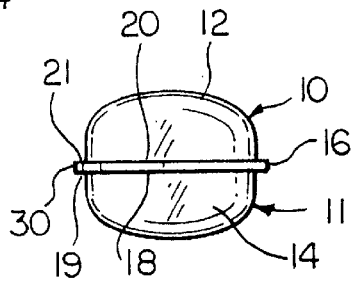
FIG. 6 is a top plan view of the structure of FIGS. 1 through 5 showing further details of the structure.
Figure 7:
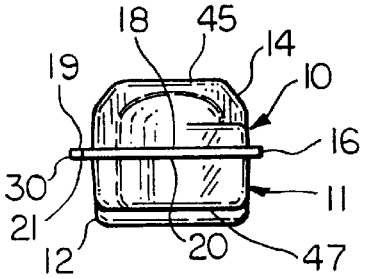
FIG. 7 is a bottom plan view showing the structure of FIGS. 1 through 7.

As best shown in FIG. 2, the closure member 14 has a planar web 18 disposed substantially about the entire periphery of the member and has portions surrounded by the web 18, extending outwardly. In similar manner as shown in FIG. 4, the base member 12 comprises a planar web 20 extending substantially about the entire periphery of the base member which has portions formed outwardly from the base member, which in conjunction with the formed portions of the closure member provide an opening within the package 10, for retaining a toothbrush.

The planar web 18 comprises a first elongated edge 22 and a flange 19 terminating in a second elongated edge 24 while the planar web 20 has a flange 21 terminating in a first elongated edge 26 and a second elongated edge 28, the first elongated edges 22 and 26 being interconnected at the hinge 16 while the second elongated edges 24 and 28 are substantially in alignment, one with the other, with the base member 12 and the closure member 14 in the closed position and the flanges 19 and 21 in contact, as shown in FIGS. 2 through 5. As best shown in the sectional views 9 through 11, the closure member 14 is provided with a lip 30 projecting substantially at right angles to the web 18 at flange 19, and the second elongated edge 28 of the base is disposed for sealing engagement, contacting the lip 30.

Figure 8:
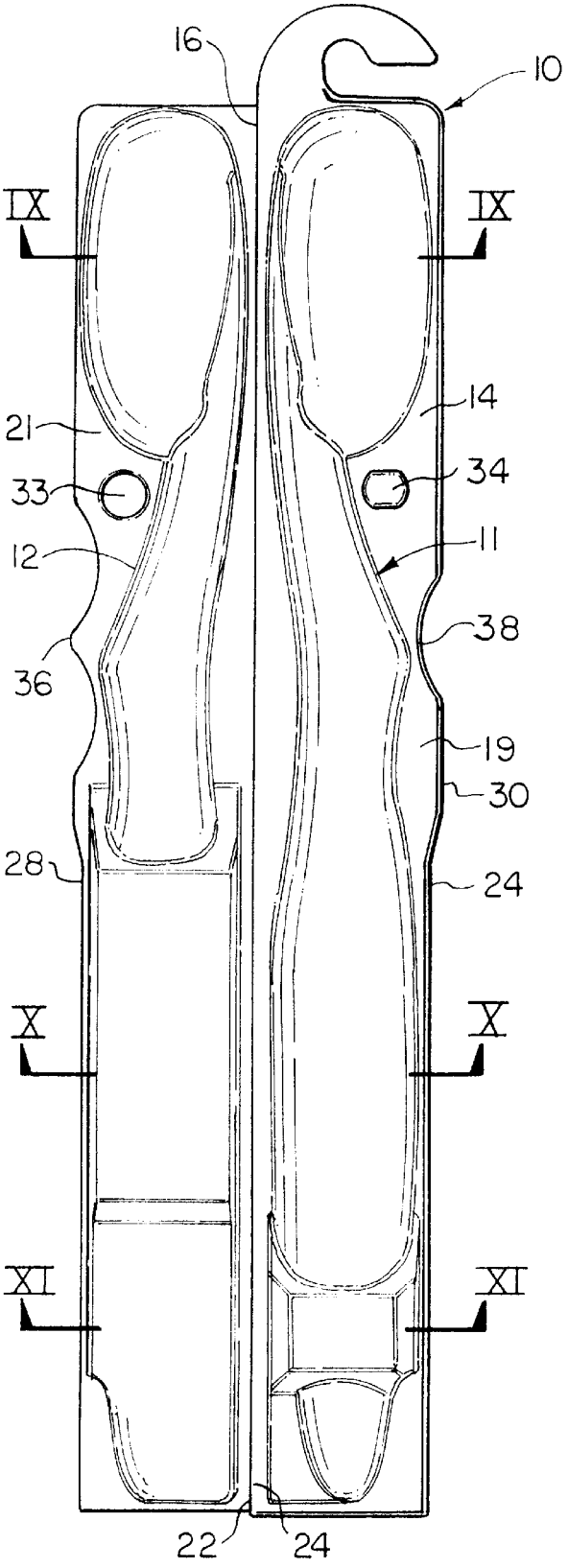
FIG. 8 is an elevational view of the structure of FIGS. 1 through 7 showing the interior of the blister package in the open condition.
Figure 9:
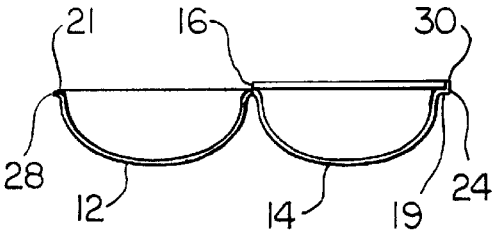
FIG. 9 is a cross-sectional view taken along the line IX—IX of FIG. 8.
Figure 10:
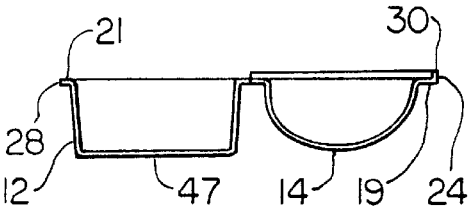
FIG. 10 is a cross-sectional view taken along the line X—X of FIG. 8.
Figure 11:
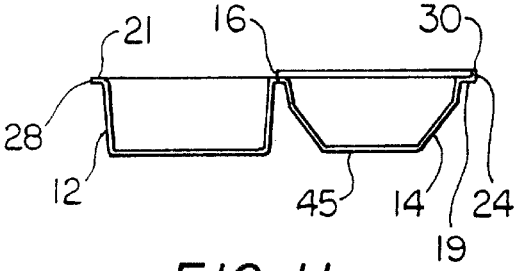
FIG. 11 is a cross-sectional view taken along the line XI—XI of FIG. 8.

To further retain the closure member 14 and the base member 12 in the closed position, a cylindrical receptacle 33, as shown in FIG. 8, is provided in the web 20 of the base member and a cylindrical protuberance 34 is formed in the web 18 of the closure member 14, the outer diameter of the cylindrical protuberance 34 forming an interference fit into the inner diameter of the cylindrical receptacle 33 such that the two may be forced together when the planar webs 18 and 20 are in mating relationship. The interference fit between the receptacle 33 and the protuberance 34 ensures that the webs 18 and 20 remain in contact, thereby ensuring a sealing engagement between the elongated edge 28 and the lip 30.

In order to facilitate opening of the package 10 from the closed position, a tab 36 is provided in the web 20 and an arcuate opening 38 is formed in the web 18 adjacent the tab. The tab 36 and the opening 38 combine to facilitate separation of the closure member 14 from the body member 12 by allowing the user to grasp the tab 36 and pull it away from the web 18.

To ensure that closure of the package remains sealed during the shipping process and prior to purchase, a plurality of frangible laser welds 40 may be provided along the webs 18 and 20 in the closed position, as shown. However, it should be understood that the engagement of the protuberance 34 with the receptacle 33 and the contact between the lip 30 and the edge 28 of the web 20 is generally sufficient to maintain the sealing engagement of the package 10.

As another feature of the present invention, it will be noted that the outwardly projecting portions of the planar webs 18 and 20 form a bulbous element 42 of the body 11 which is substantially oval in cross section and retains the head of the toothbrush. At the opposite end of the package 10 a rectangular planar surface 45 is formed substantially in alignment with the outer surface of the bulbous element 42. When the package 10 is employed for retaining the toothbrush after purchase, the surface 45 and the outer surface of the bulbous element 42 serve as a combined support for the package 10 when it is resting on a shelf or a cabinet and prevents rolling of the package over the surface. Likewise, the base member 12 is provided with a rectangular planar surface 47 which extends outwardly from the web 20 substantially to the same extent as the bulbous element 42, and will provide a similar support on the opposite side of the package 10.

Thus, it will be seen that the package 10 provides a device for both display and storage of a toothbrush, which package is easily carried on the person of the user and retains a seal from contaminants due to the sealing engagement of the base member to the closure member. With the location of the planar surfaces 45 and 47, the package may also be received on any flat surface where the user is employing the toothbrush.

While it is apparent that changes and modifications can be made within the spirit and scope of the present invention, it is our intention, however, only to be limited by the appended claims. As our invention we claim:

We claim:

1. A blister package for display and storage of a toothbrush comprising:

a unitary elongate molded plastic body having a base member, a closure member and a molded hinge portion connecting said base member to said closure member for movement of said base member and said closure member from a closed position forming a cavity therebetween for accommodating a toothbrush, to an open position allowing access to within said cavity;

said base member further comprising a planar web extending substantially around the entire periphery of said base member and having a first elongated edge connected to said molded hinge portion and forming a flange having a second elongated edge extending opposite said hinge portion;

said closure member comprising a planar web extending substantially around the entire periphery of said closure member and having a first elongated edge connected to said molded hinge portion and forming a flange having a second elongated edge extending opposite said hinge portion;

said second elongated edges being in alignment and said closure member flange overlying and contacting said base member flange with said base member and said closure member in the closed position;

said base member further having a first arcuate recess extending outwardly therefrom forming a portion of said cavity and said closure member having a second arcuate recess extending outwardly therefrom forming a portion of said cavity, said first arcuate recess and said second arcuate recess being disposed in facing relationship one with the other to form a bulbous element substantially oval in cross section with said base member and said closure member in the closed position;

said closure member flange second edge having a lip formed thereon over at least a portion of the length thereof and extending toward said base member second edge in contacting engagement against said lip with said closure member and said base member in the closed position;

a protuberance having an outer surface formed on one of said flanges;

an opening formed on the other of said flanges, said protuberance outer surface extending through said opening in interference fit to retain said members in the closed position; and a first planar surface formed on said base member planar web substantially in alignment with at lease a portion of the outer surface of said bulbous element and a second planar surface formed on said closure member planar web substantially in alignment with the outer surface of said bulbous element, said planar surfaces serving to combine with said bulbous element outer surface to support said blister packages.

2. A blister package as set forth in claim 1 wherein a tab is formed on one of said flanges overlying the other of said flanges to facilitate movement of said closure member and said base member from a closed position to an open position.

3. A blister package as set forth in claim 1 wherein said molded plastic body is manufactured of a polyvinyl chloride material.

4. A blister package as set forth in claim 1 wherein said base member flange and said closure member flange are interconnected by a plurality of frangible connections.

* * * * *